US007095975B2

(12) United States Patent
Shirai et al.

(10) Patent No.: US 7,095,975 B2
(45) Date of Patent: Aug. 22, 2006

(54) COPYING MACHINE AND COPYING METHOD

(75) Inventors: Takaaki Shirai, Nagoya (JP); Motonobu Ando, Okazaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 95 days.

(21) Appl. No.: 10/751,414

(22) Filed: Jan. 6, 2004

(65) Prior Publication Data

US 2004/0161264 A1 Aug. 19, 2004

(30) Foreign Application Priority Data

Jan. 7, 2003 (JP) ..... 2003-001451

(51) Int. Cl.
*G03G 15/00* (2006.01)

(52) U.S. Cl. ..... 399/376; 399/196; 399/197; 399/86; 399/370

(58) Field of Classification Search ..... 399/86, 399/197, 196, 376, 370; 382/170
See application file for complete search history.

(56) References Cited

U.S. PATENT DOCUMENTS 4,682,877 A * 7/1987 Fujiwara et al. ..... 399/376
5,613,017 A * 3/1997 Rao et al. ..... 382/174
6,516,178 B1 * 2/2003 Fukushima ..... 399/376
6,701,124 B1 * 3/2004 Sakai et al. ..... 399/376
6,901,237 B1 * 5/2005 Nakamura ..... 399/367

FOREIGN PATENT DOCUMENTS

JP 2000-175030 * 6/2000
JP A 2000-172117 6/2000
JP A 2000-175030 6/2000

* cited by examiner

*Primary Examiner*—David M. Gray
*Assistant Examiner*—Ryan D. Walsh
(74) *Attorney, Agent, or Firm*—Oliff & Berridge, PLC

(57) ABSTRACT

An Flat Bed-Multi Function Device includes an MPU, a reading section, a recording section, an operation section, an image memory, and a ratio changing section. In a reduction copy mode, the reading section reads an extended reading area of a document larger than a recording area of recording paper to generate image data. The ratio changing section reduces the image data at a predetermined reduction ratio. The recording section forms an image on a sheet of recording paper on the basis of the reduced image data.

36 Claims, 11 Drawing Sheets

COPYING MACHINE AND COPYING METHOD

BACKGROUND OF THE INVENTION

1. Field of the Invention

The present invention relates to a copying machine including a reading unit for reading a document to generate image data, and a recording unit for recording an image on a recording medium based on the image data, and a copying method.

2. Description of the Related Art

In the background art, there is known a multifunctional apparatus having a copying function for making a copy of a document. The multifunctional apparatus has an image reading section such as a CCD (Charge Coupled Device) or a CIS (Contact Image Sensor) for reading while scanning a document to generate image data. The multifunctional apparatus also includes a recording section (such as a laser printer or an ink jet printer) for recording an image on a predetermined recording area of a sheet of recording paper on the basis of the image data. For example, MFC-9800 is a multifunctional apparatus made by Brother Kogyo Kabushiki Kaisha.

When this type multifunctional apparatus is applied to an A4 size, the maximum document size is an A4 size (document width: 210 mm) or a letter size (document width: 216 mm). As shown in FIG. 9A, only an area corresponding to the recording area of recording paper can be read from a document by the image reading section at the time of copying in order to reduce the data amount of image data. The width of the recording area (the horizontally recordable width in FIG. 9A) is 206 mm. Left and right margins (2 mm-wide margins in the A4 size or 5 mm-wide margins in the letter size) of the document are not read by the image reading section because images on the left and right margins cannot be recorded on a sheet of recording paper.

Also, top and bottom margins of the document are not read by the image reading section, either.

This is for the following reason. When the multifunctional apparatus is used as a facsimile machine or as a scanner, it is necessary to read all the designated area. However, when the multifunctional apparatus is used as a copying machine, it is wasteful to read the other area than the recordable area because the recordable area is known from the start. Accordingly, when the multifunctional apparatus is used as a copying machine, only the recordable area is read in order to improve both memory efficiency and processing speed.

When the multifunctional apparatus according to the related art is used as a copying machine, the image reading section does not read peripheral margins of the document as described above. Therefore, image data does not contain an image recorded on the peripheral margins. For this reason, as shown in FIG. 9B, images recorded on the peripheral margins of the document cannot be recorded on the sheet of recording paper when image data are reduced and recorded. There is a problem that a wide blank portion is produced in a peripheral portion of the recording area because image data are missing in the peripheral portion of the recording area.

Moreover, when the image reading section reads the document in the condition that the document is skewing, a certain portion that is supposed to be present in the area read by the image reading section originally (when the document is not skewing) may be out of the readable area. As a result, the certain portion cannot be recorded on the sheet of recording paper and is missing. There is a problem that copying loss increases.

SUMMARY OF THE INVENTION

The invention has been made under such circumstances and an object of the invention is to provide a copying machine and a copying method in which a peripheral area in respective end portions of a document can be recorded on a recording medium in a reduction copy mode so that loss in copying area can be reduced even in the case where the document is skewing.

According to a first aspect of the invention, a copying machine includes a reading unit, a reducing unit, and a recording unit. The reading unit reads a document to generate image data. The reducing unit reduces the image data at a predetermined reduction ratio to generate reduced image data. The recording unit forms an image in a predetermined recording area on a recording medium on the basis of one of the image data generated by the reading unit and the reduced image data generated by the reducing unit. At least when the recording unit forms the image on the basis of the reduced image data, the reading unit reads an extended reading area of the document larger than the recording area.

In the embodiment of the invention, when a document is to be subjected to reduction copying, an extended reading area larger than the recording area is read from the document to generate image data. Accordingly, the image data contain an image on the outside of the recording area as well as an image on the inside of the recording area.

When the image data are then reduced and recorded on a recording medium, (at least a part of) the image on the outside of the recording area of the document can be recorded on the recording medium because the image is present within the recording area of the recording medium.

That is, when the embodiment of the invention is applied to the case where a document is to be subjected to reduction copying, the portion of the document outside the recording area can be also recorded on the recording medium, so that the missing portion of the image (a portion of the image recorded on the document but not recorded on the recording medium) formed on the recording medium can be reduced.

Moreover, when the document is skewing, a certain portion that is supposed to be present in the inside of the recording area of the document (when the document is placed correctly) may come out of the recording area. In the embodiment of the invention, even such a portion that comes out of the recording area due to the skewing of the document can be read so as to be contained in the image data as described above because the extended reading area larger than the recording area is read from the document.

When the image data are then reduced and recorded on a recording medium, (at least a part of) the image on the portion coming out of the recording area due to the skewing of the document can be recorded on the recording medium because the image is present within the recording area of the recording medium.

That is, when the embodiment of the invention is applied to the case where a document is to be subjected to reduction copying, the portion not allowed to be recorded on a recording medium can be reduced even in the case where the document is skewing.

The term "reduction ratio" means the ratio of the size of an image formed on a recording medium by the recording unit to the size of an image on a document.

According to a second aspect of the invention, a copying method includes reading a document to generate image data; reducing the image data at a predetermined reduction ratio to generate reduced image data; and forming an image in a predetermined recording area on a recording medium on the basis of one of the image data generated in the reading and the reduced image data generated in the reducing. At least when in the forming, the image is formed on the basis of the reduced image data, an extended reading area of the document, which is larger than the recording area, is read in the reading.

According to a third aspect of the invention, A copying machine includes a reduction ratio setting section, a control section, an effective area setting section, a reading section, a data processing section, and a recording section. The reduction ratio setting section sets a reduction ratio. The control section compares the reduction ratio with a threshold value. The effective area setting section detects a length of a document in a main scanning direction to set an effective area. The reading section reads the document to generate image data. The data processing section reduces the image data on the basis of a comparison result provided by the control section, the image data, and the effective area. The recording section forms an image on a recording area of a recording medium on the basis of the image data reduced by the data processing section.

DETAILED DESCRIPTION OF THE PREFERRED EMBODIMENTS

Embodiments of the invention as to a copying machine and a copying method will be described below.

Figure 10:
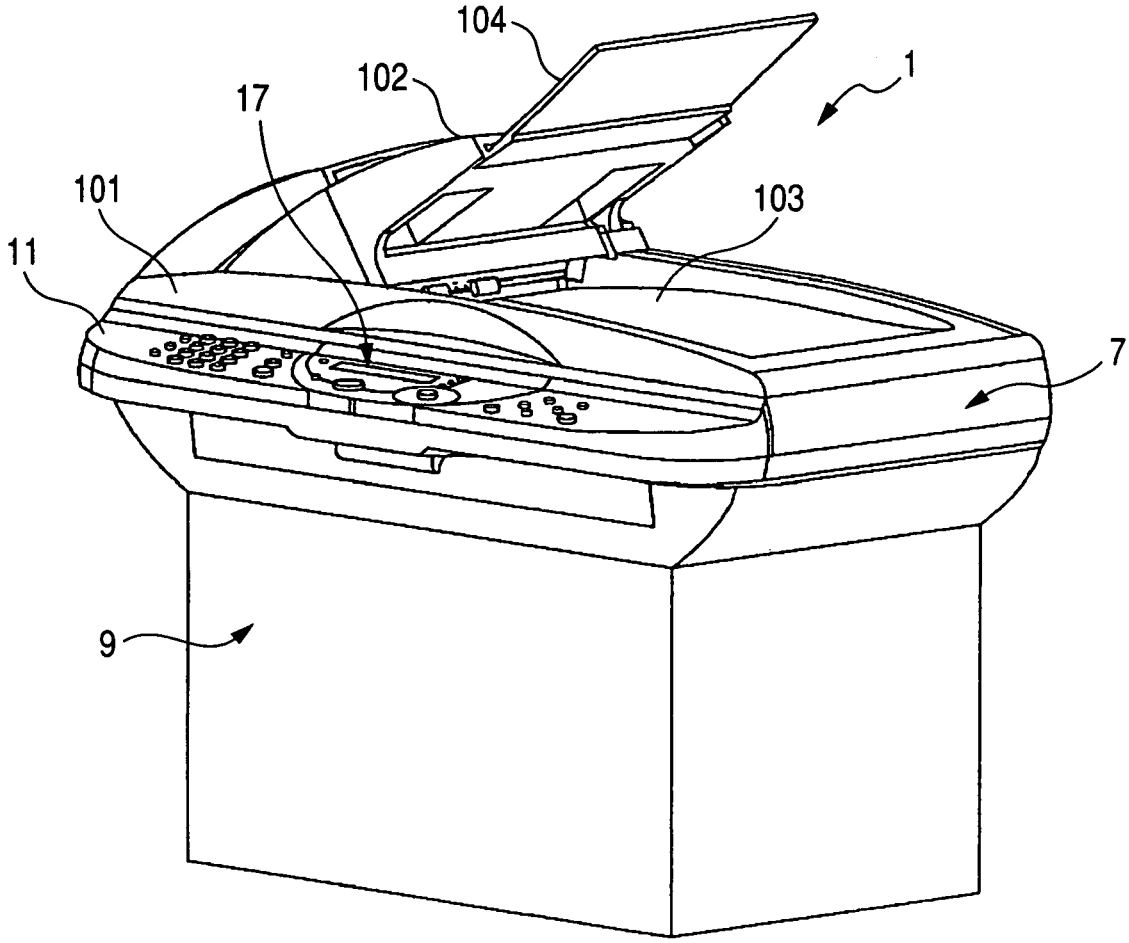
FIG. 10 is a view showing a perspective view of an example of a multi function device 1 to which the invention is applied.
Figure 11:
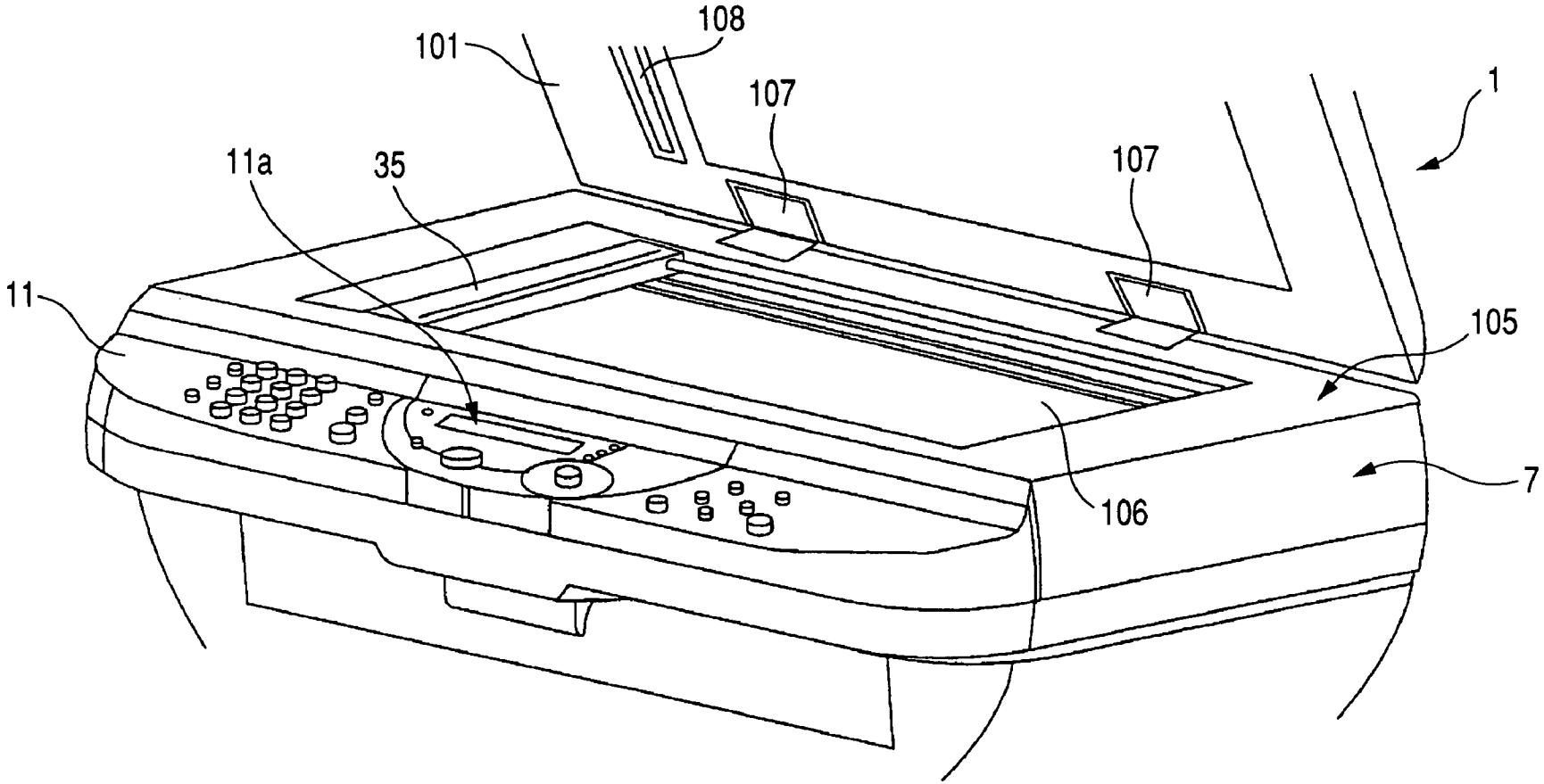
FIG. 11 is a view showing a perspective view of the example of the multi function device 1 in a condition where a document table cover 101 opens.

FIG. 10 shows a perspective view of an example of a multi function device (MFD) 1 to which the invention is applied. FIG. 11 is a perspective view of the multi function device 1 in where a documentable cover 101 opens.

As shown in FIG. 10, the MFD 1 includes a recording section 9 disposed at a lower part thereof and a reading section 7 disposed at an upper part thereof. The reading section 7 and the recording section 9 operate to realize a printing function, an image reading function, and a copying function. Incidentally, although the recording section 9 is formed in a rectangle shape in FIG. 10, the recording section 9 may include a discharge port to which a paper discharge tray is attached detachably, and a paper feed cassette.

The MFD 1 also includes an operation section 11 and an display section 17 at the upper part on a front side. The operation section 11 includes operation buttons (keys 21, 23, 25, 27, 29, 31, 33 described later) used for inputting various instructions. The display section 17 displays an operation state of the MFD 1 thereon.

The MFD 1 also includes at the upper part a document table cover 101, which rotates upward around hinges 107 disposed at a backward of the MFD 1.

As shown in FIG. 11, the MFD 1 is a FB-MFD (Flat Bed-Multi Function Device). The MFD 1 is configured so that a line type-CCD image sensor 35 reads an image from a document placed on a platen glass 106 of a document table 105.

The CCD image sensor 35 moves in a sub-scanning direction along the platen glass 106, interlocking with a belt driven by a drive motor (not-shown).

In addition, the MFD 1 includes an ADF(Auto Document Feeder) mechanism 102 (FIG. 10) for reading images from a plurality of documents sequentially. The ADF mechanism 102 operates as follows under a condition where the document table cover 101 is closed and the CCD image sensor 35 is fixed at a reading initial position. First, the ADF mechanism 102 brings in the documents one by one from a document feed tray 104 (FIG. 10) and makes the document pass through a document pass portion 108 disposed above the CCD image sensor 35. Thereby, the CCD image sensor 35 reads an image line by line, and the document, which has been read, is discharged to a document discharge tray 103 (FIG. 10).

Accordingly, the MFD 1 can read images from a plurality of documents placed on the document feed tray 104 page by page continuously, and in addition, the MFD 1 also can read an image of a document placed on the platen glass 106 by a user page by page.

Embodiment 1

Figure 1:
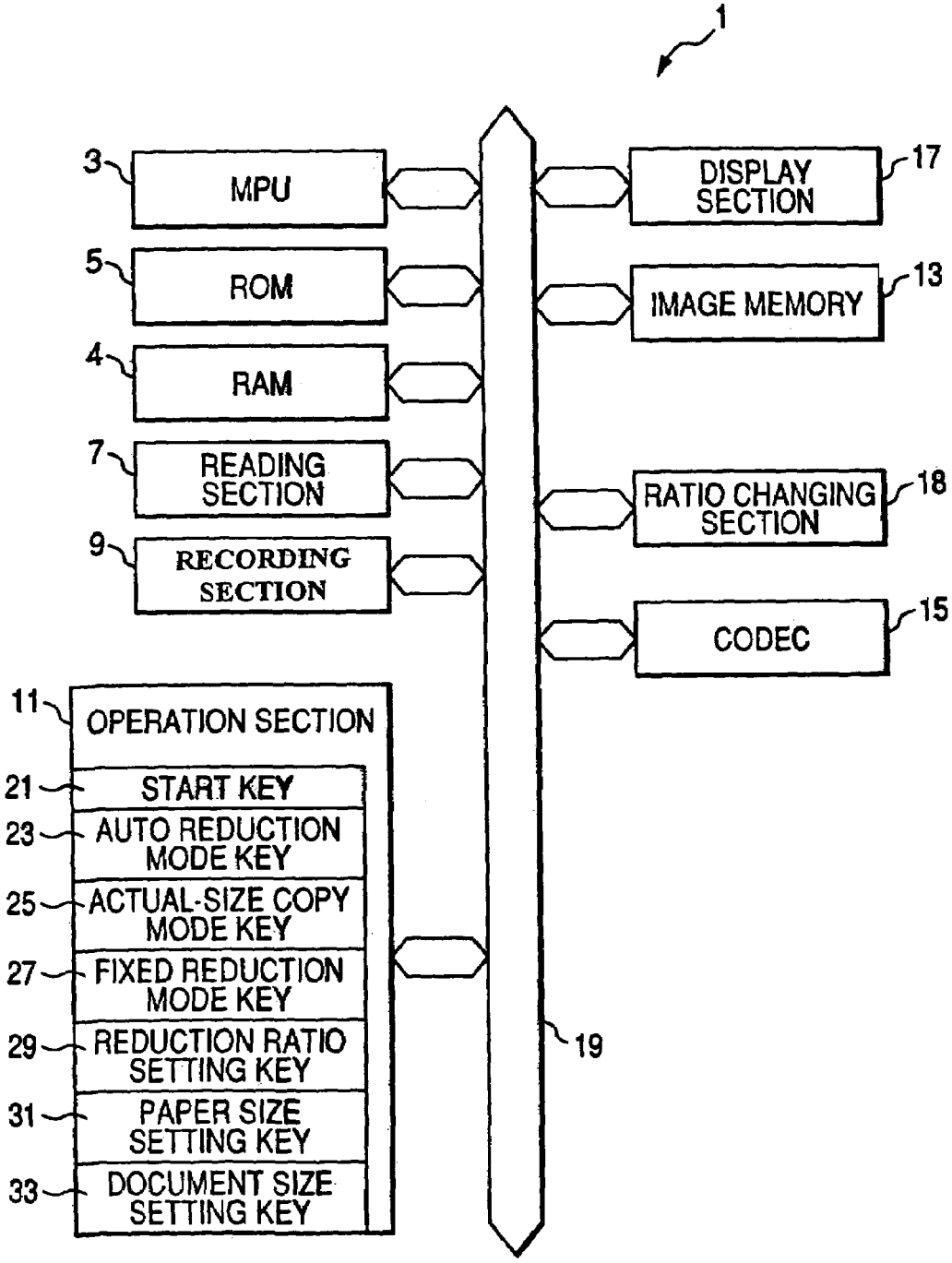
FIG. 1 is a block diagram showing a configuration of an FB-MFD according to an embodiment of the invention.

The embodiment 1 relates to a case where the MFD 1 is an FB-MFD (Flat Bed-Multifunction Device), which is a multi function device having the platen glass 106 on which a document can be placed, and the document table cover 101 for covering the platen glass 106 is taken as an example of the copying machine. In other words, the FB-MFD 1 may not include the ADF mechanism 102, the document discharge tray 103, and the document feed tray 104.

a) The configuration of an FB-MFD (copying machine) according to the embodiment 1 will be first described with reference to FIG. 1.

In the embodiment 1, the FB-MFD 1 includes an MPU 3, an RAM 4, an ROM 5, a reading section 7, a recording section 9, an operation section 11, an image memory 13, a codec 15, a display section 17, and a ratio changing section 18. The respective parts 3 to 18 are connected to one another through a bus 19.

The MPU 3 controls the respective constituent parts of the FB-MFD 1.

The RAM 4 is a random access memory on which a work area used by the MPU 3 is expanded.

The ROM 5 stores programs for controlling the FB-MFD 1.

The reading section 7 is a reading unit for reading a document placed on the document table glass plate to generate image data. The specific configuration of the reading section 7 will be described later in detail.

The recording section 9 is an electrophotographic color printer having toner casings (not shown) for storing four kinds of toner, namely, cyan toner, magenta toner, yellow toner and black toner respectively. The recording section 9 operates so that image data read by the reading section 7 in a copying operation are recorded on a sheet of recording paper not shown.

Incidentally, the recording section 9 may be an ink jet color printer having ink cassettes for storing four kinds of ink, namely, cyan ink, magenta ink, yellow ink and black ink respectively instead of the electrophotographic color printer. If there is no black toner (ink), the recording section 9 may be configured so that three kinds of toner (ink), namely, cyan toner (ink), magenta toner (ink) and yellow toner (ink) are used. Alternatively, the recording section 9 may be an electrophotographic or ink jet monochrome printer.

An area of the recording section 9 on which recording can be made on a sheet of recording paper is an area having a length of 291 mm in the lengthwise direction and a width of 206 mm in the widthwise direction. Incidentally, the term "lengthwise direction" means a direction equivalent to a sub-scanning direction which will be described later in the description of the reading section 7 whereas the term "widthwise direction" means a direction equivalent to a main scanning direction which will be described later in the description of the reading section 7.

The operation section 11 has various kinds of operation keys such as a start key 21, an auto reduction mode key 23, an actual-size copy mode key 25, a fixed reduction ratio mode key 27, a reduction ratio setting key 29, a paper size setting key 31, and a document size setting key 33. The start key 21 is used for making the reading section 7 start reading of a document. The auto reduction mode key 23 is used for deciding the reduction ratio of copying automatically in accordance with the document size and the recording paper size. Incidentally, a method of setting the reduction ratio will be described later in detail. The actual-size copy mode key 25 is used for setting the reduction ratio of copying at the actual size. The fixed reduction ratio mode key 27 is an input key used for setting the scaling factor (reduction ratio) of copying as a fixed value smaller than 100%. When the fixed reduction ratio mode key 27 is input, the reduction ratio of copying can be set by the reduction ratio setting key 29. The reduction ratio setting key 29 is provided with a numeric key pad not shown. The reduction ratio (e.g., a predetermined reduction ratio in a range of from 1% to 99%) can be input through the numeric keypad. The reduction ratio setting key 29 may include a ratio increment key for increasing the ratio by a predetermined value for every pushing, and a ratio decrement key for decreasing the ratio by a predetermined value for every pushing, in addition to or in place of the numeric keypad. The paper size setting key 31 is used for inputing the size of recording paper on which an image will be formed by the recording section 9. A4 size, letter size, etc. can be set as the recording paper size. The document size setting key 33 is used for inputing the size of the document to be read by the reading section 7. A4 size, letter size, etc. can be set as the document size.

The image memory 13 is a memory for storing image data read by the reading section 7.

Before the image data read by the reading section 7 are stored in the image memory 13, the codec 15 encodes the image data by bandwidth compression according to a known compression technique such as MH, MR, MMR, JBIG, etc. The codec 15 also decodes the image data read from the image memory 13.

The display section 17 displays various kinds of information such as settings input through the operation section 11 and the operating state of the FB-MFD 1.

Figure 2:
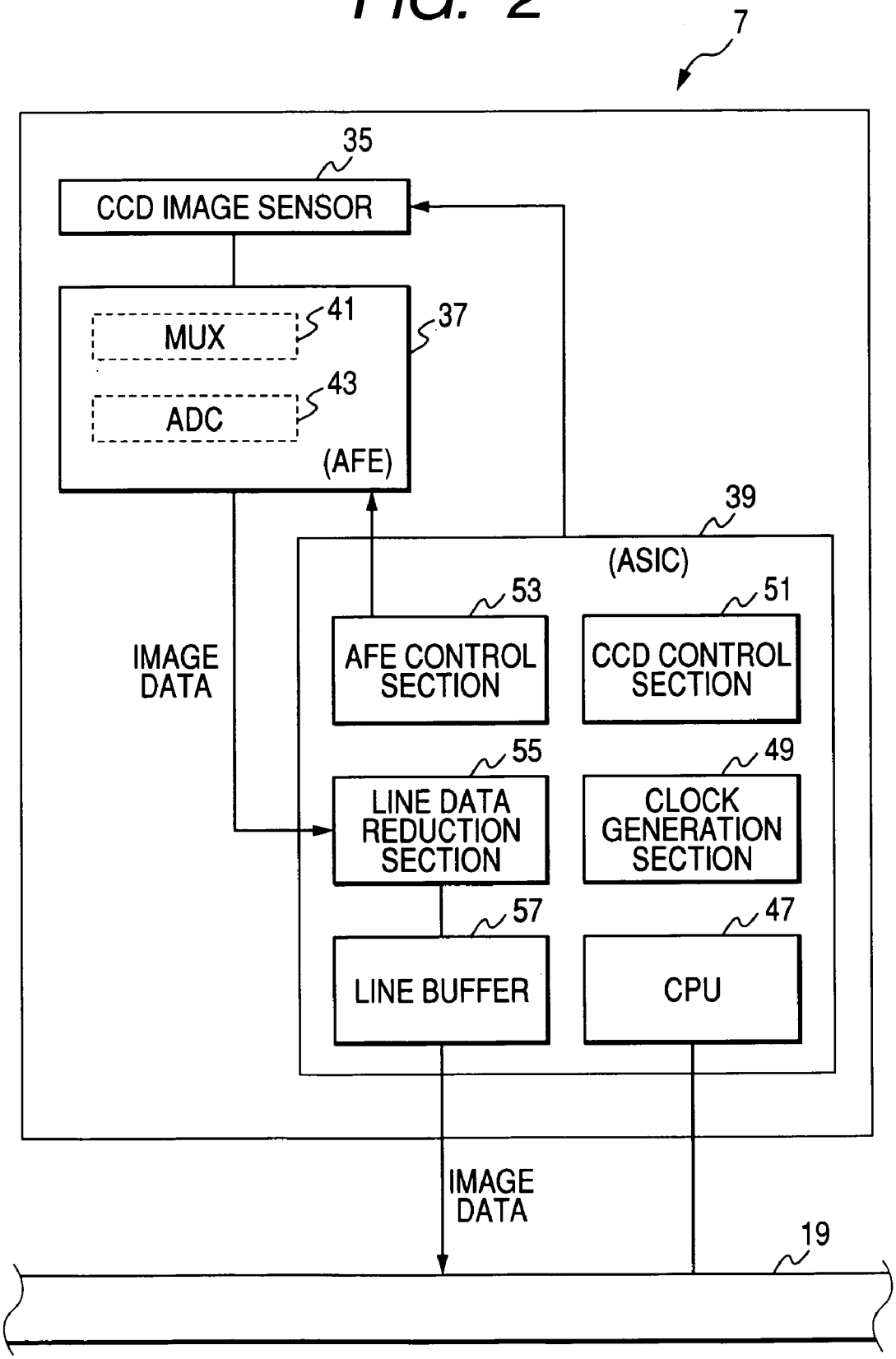
FIG. 2 is a block diagram showing a configuration of the FB-MFD according to the embodiment.

When the fixed reduction ratio mode key 27 is selected in the operation section 11, the reduction ratio input by the reduction ratio setting key 29 is stored in the ratio changing section 18. When the auto reduction mode key 23 is selected in the operation section 11, the reduction ratio set by a process, which will be described later, is stored in the ratio changing section 18. In this manner, the image data stored in the image memory 13 can be reduced at the stored reduction ratio. When, for example, the reduction ratio is set at 50%, the image data are thinned out on alternate pixels to reduce the size to 50%. It is noted that the term "reduction ratio" means a "scaling ratio". For example, when the stored reduction ratio is 75%, the image data stored in the image memory is scaled down to 75%.

b) The configuration of the reading section 7 will be described below specifically with reference to FIG. 2.

The reading section 7 has the CCD (Charge-Coupled Device) image sensor 35, an analog front end (AFE) IC 37, and an application specific integrated circuit (ASIC) 39.

The CCD image sensor 35 reads a document placed at a predetermined position of the platen glass 106 and supplies pixel signals to the analog front end IC 37.

The CCD image sensor 35 includes a line sensor having elements fixed on a straight line parallel to a predetermined direction (main scanning direction) relative to the document, and a drive portion for driving the line sensor to scan the document in a sub-scanning direction (in a direction perpendicular to the main scanning direction). The line sensor is controlled so that one-line's pixel signals are acquired whenever the line sensor makes a step in the sub-scanning direction.

The area to be read from the document by the CCD image sensor 35 can be decided as follows. That is, when the image pick-up range of the line sensor is set, the document reading range in the main scanning direction is decided automatically. When the scanning range of the line sensor in the sub-scanning direction is set, the document reading range in the sub-scanning direction is decided automatically.

When the actual-size copy mode key 25 is selected in the operation section 11 on the assumption that an A4-size document (297 mm long and 210 mm wide) is used, the area to be read by the CCD image sensor 35 is an area having a length of 291 mm in the sub-scanning direction as the lengthwise direction of the document, and a width of 206 mm in the main scanning direction as the widthwise direction of the document. That is, 3 mm-wide top and bottom margins in the sub-scanning direction and 2 mm-wide left and right margins in the main scanning direction are not read from the document. The area having a length of 291 mm in the sub-scanning direction and a width of 206 mm in the main scanning direction is an area equal (equivalent) to the recordable area of the recording section 9.

When the fixed reduction ratio mode key 27 or the auto reduction mode key 23 is selected in the operation section 11, an area having a length of 297 mm in the sub-scanning direction and a width of 212 mm in the main scanning direction is read from the A4-size document. That is, the document is read in a range of from the top to the bottom of the document in the sub-scanning direction but the document is read in a range of from a position 1 mm distant outward from the left end to a position 1 mm distant outward from the right end of the document in the main scanning direction.

The analog front end IC 37 includes a multiplexer (MUX) 41, and an analog-digital converter (ADC) 43. The multiplexer 41 inputs pixel signals obtained from the CCD image sensor 35 to the analog-digital converter 43 successively. The analog-digital converter 43 converts the pixel signals into image data as digital signals and supplies the image data to the ASIC 39.

The ASIC 39 includes a CPU 47, a clock generation section 49, a CCD control section 51, an AFE control section 53, a line data reduction section 55, and a line buffer (buffer) 57.

The CPU 47 controls the ASIC 39 as a whole. The clock generation section 49 generates a reference clock signal for synchronously operating the CCD image sensor 35 and the respect parts of the analog front end IC 37 and the ASIC 39. The CCD control section 51 controls and drives the CCD image sensor 35 in accordance with the number of reference clock pulses obtained from the clock generation section 17. The AFE control section 53 applies various kinds of settings to the analog front end IC 37 to perform offset control and gain control.

The line data reduction section 55 reduces the output image data of the analog-digital converter 43 to a size allowed to be stored in the line buffer 57 for every line image data (image data generated whenever an image of one line on the document is picked up by the line sensor of the CCD image sensor 35) and stores the reduced line image data in the line buffer 57. The line buffer 57 once holds the line image data and then supplies the line image data to the codec 15 (FIG. 1) successively.

c) A copying method executed by the FB-MFD 1 according to the embodiment 1 will be described below with reference to FIGS. 3 to 5.

Figure 3:
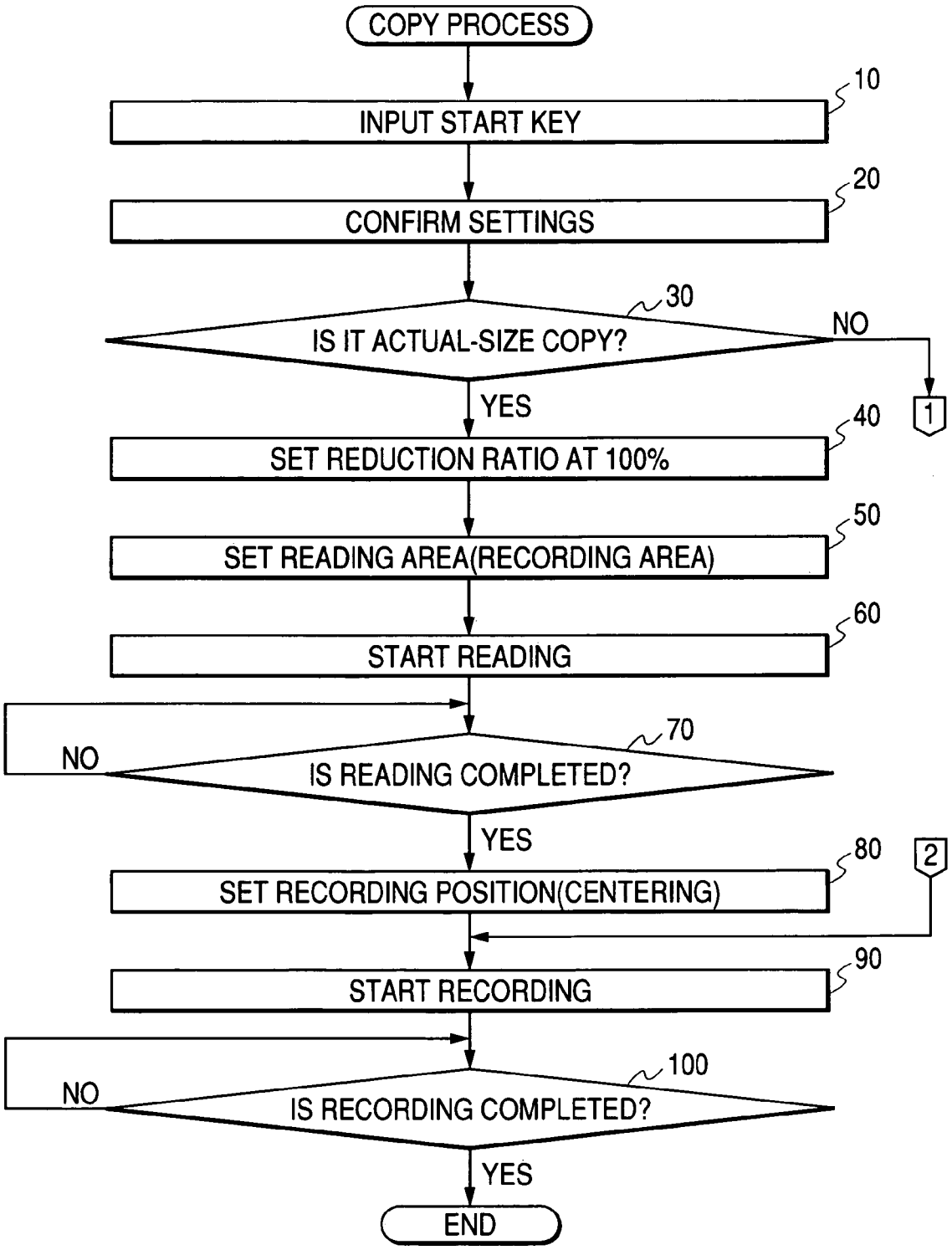
FIG. 3 is a flow chart showing a process executed by the FB-MFD according to the embodiment.
Figure 4:
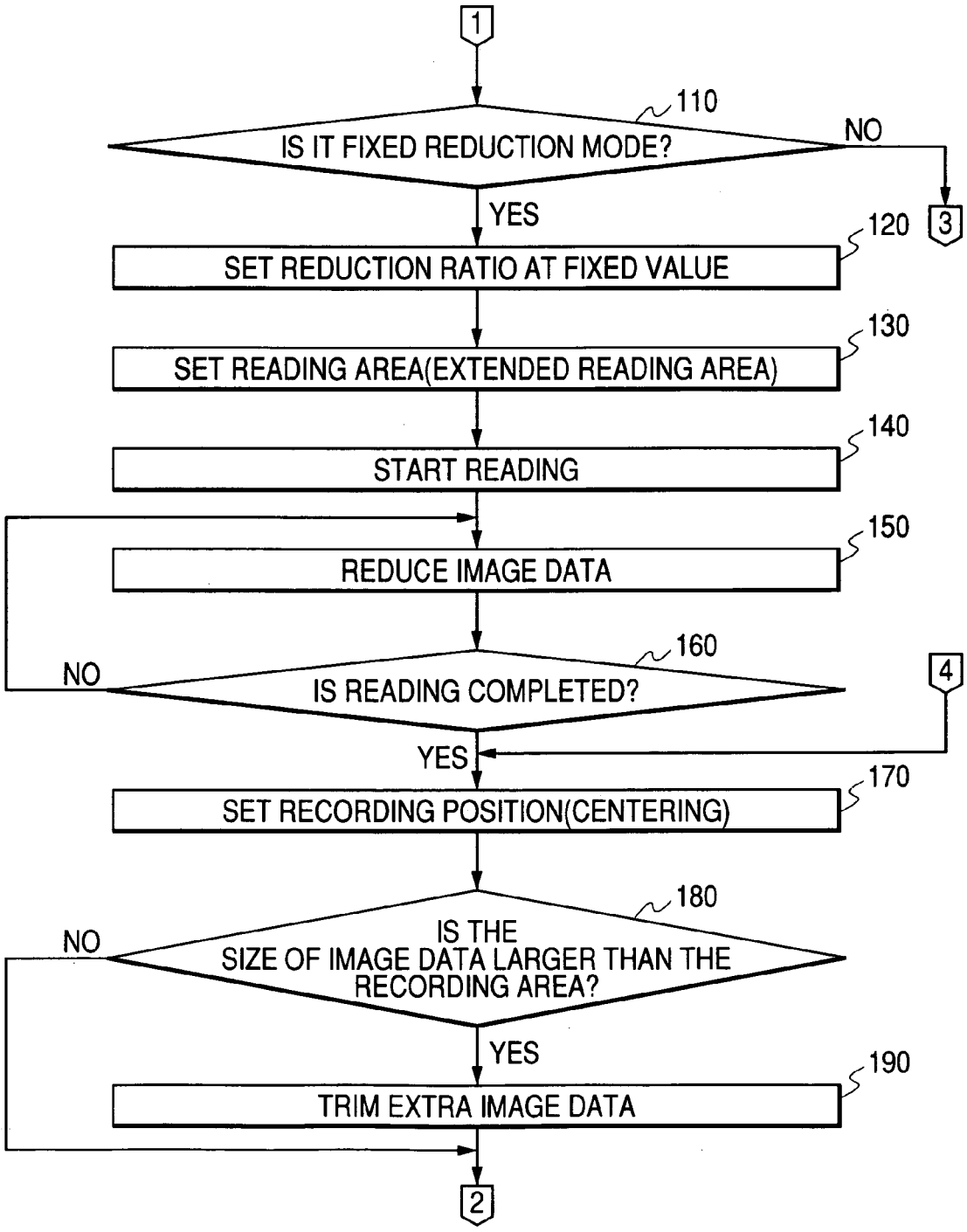
FIG. 4 is a flow chart showing the process executed by the FB-MFD according to the embodiment.
Figure 5:
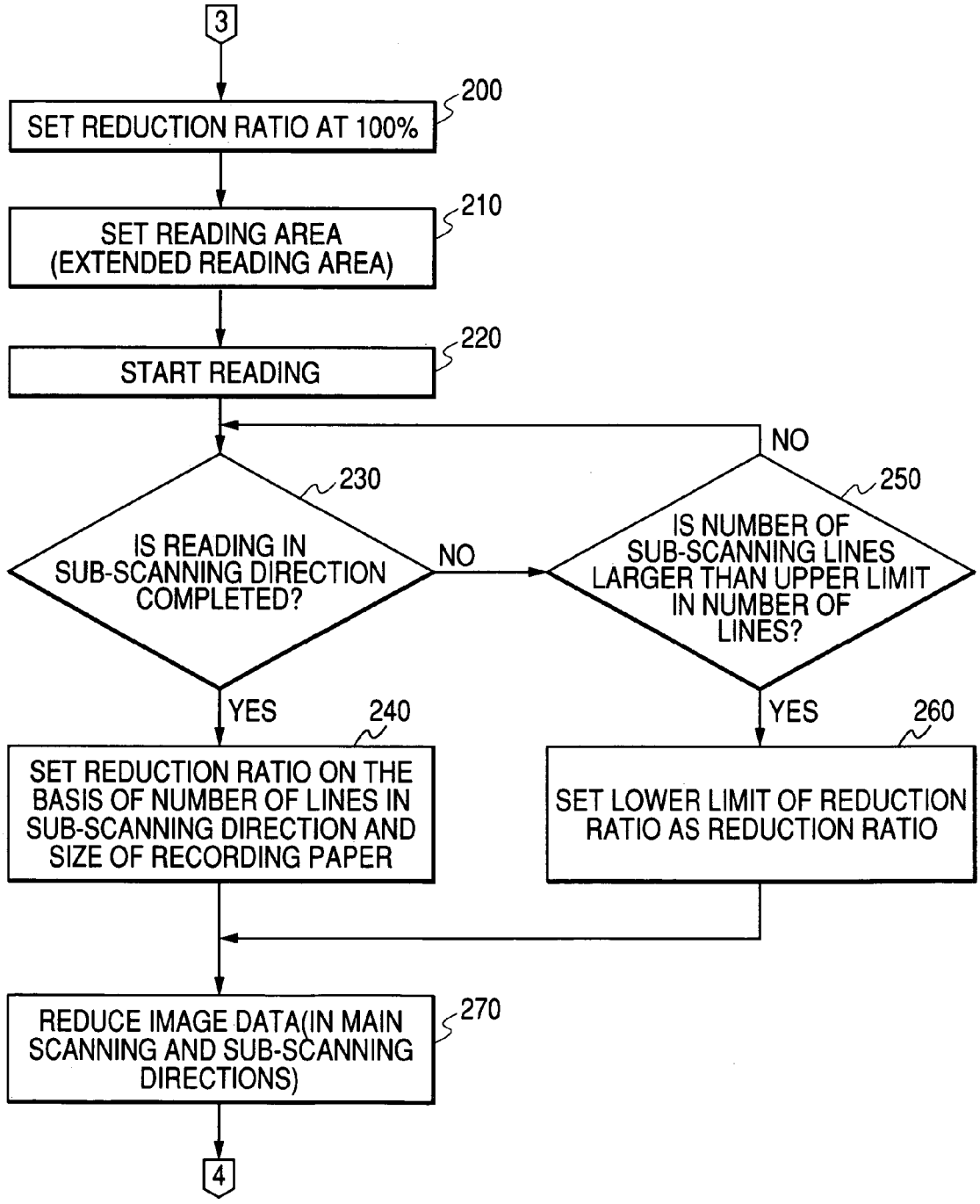
FIG. 5 is a flow chart showing the process executed by the FB-MFD according to the embodiment.

FIGS. 3 to 5 are flow charts showing a copying process. The copying process starts when an operator pushes down the start key 21 of the operation section 11 (step 10). Incidentally, before the operator pushes down the start key 21, the operator can input various kinds of settings for copying through the operation section 11.

In step 20, the contents of settings input by the operator through the operation section 11 are confirmed. Specifically, it is first confirmed as to which of the auto reduction mode key 23, the actual-size copy mode key 25 and the fixed reduction ratio mode key 27 the operator selects. When it is confirmed that the fixed reduction ratio mode key 27 is selected, the reduction ratio set by the operator through the reduction ratio setting key 29 is further confirmed. The recording paper size input by the operator through the paper size setting key 31 and the document size input by the operator through the document size setting key 33 are further confirmed. Assume that A4 size is used as each of the document size and the recording paper size in the embodiment 1. The document is placed at a predetermined position of the platen glass 106 of the reading section 7 so that the lengthwise direction of the document is parallel to the sub-scanning direction of the CCD image sensor 35.

In step 30, a judgment is made as to whether the actual-size copy mode key 25 is selected by the operator or not. In the case of "YES", the process proceeds to step 40. In the case of "NO", the process proceeds to step 110 (FIG. 4).

In step 40, the reduction ratio of the ratio changing section 18 is set at 100% in accordance with the decision, which is made in the step 30 that the actual-size copy mode key 25 is selected.

In step 50, an area (an area corresponding to a recording area in which the recording section 9 can record on a sheet of recording paper) having a length of 291 mm in the sub-scanning direction and a width of 206 mm in the main scanning direction is set as an area of a document, which the CCD image sensor 35 of the reading section 7 reads, placed at a predetermined position of the platen glass 106. That is, 3 mm-wide top and bottom margins in the sub-scanning direction and 2 mm-wide left and right margins in the main scanning direction are not read from the document.

In step 60, the CCD image sensor 35 starts reading the document. Specifically, reading starts at an end of the area set in the step 50 while the line sensor of the CCD image sensor 35 is moved stepwise in the sub-scanning direction. Pixel signals output from the CCD image sensor 35 reading the document are converted into image data as digital signals by the analog front end IC 37. The image data are once stored in the line buffer 57 through the line data reduction section 55. The line buffer 57 sends the image data to the codec 15 (FIG. 1). The image data are encoded by the codec 15 and stored in the image memory 13 (FIG. 1).

In step 70, a judgment is made as to whether reading of all the area set in the step 50 is completed or not. In the case of "YES", the process proceeds to step 80. In the case of "NO", the step 70 is repeated.

In step 80, centering is made so that an image will be formed on the center of the sheet of recording paper when the image is formed on the sheet of recording paper by the recording section 9 based on the image data generated in the step 60. The detailed description of the centering will be omitted because the centering is a known technique.

In step 90, the recording section 9 starts recording on the sheet of recording paper while the image data read from the image memory 13 are decoded by the codec 15 and supplied to the recording section 9.

In step 100, a judgment is made as to whether supply of the image data to the recording section 9 is completed or not. In the case of "YES", this process is terminated. In the case of "NO", the step 100 is repeated.

In this embodiment, when image data are not reduced, the reading section 7 reads the recording area of the document so that the size of image data can be reduced than that in a case where the reading section 7 reads the extended reading area of the document.

Accordingly, the capacity of the image memory 13 for recording the image data can be reduced, so that the time required for writing/reading the image data can be shortened.

On the other hand, when the judgment in the step 30 results in "NO", the process proceeds to step 110 (FIG. 4) in which a judgment is made as to whether the fixed reduction ratio mode key 27 is selected in the operation section 11 by the operator or not. In the case of "YES", the process proceeds to step 120. In the case of "NO", the process proceeds to step 200 (FIG. 5).

In step 120, a value (e.g., any value in a range of from 1% to 99%) input by the operator through the reduction ratio setting key 29 is set as the reduction ratio of the ratio changing section 18.

In step 130, an area having a length of 297 mm in the sub-scanning direction and a width of 212 mm in the main scanning direction is set as the area by which the document placed at the predetermined position of the platen glass 106 will be read by the CCD image sensor 35 of the reading section 7. That is, the area is set so that a range of from the top to the bottom of the document can be entirely read in the sub-scanning direction but a range of from a position 1 mm distant outward from the left end to a position 1 mm distant outward from the right end of the document can be read in the main scanning direction.

In step 140, the CCD image sensor 35 starts reading the document. Specifically, reading starts at an end of the area set in the step 130 so that data can be read line by line while the line sensor of the CCD image sensor 35 is moved stepwise in the sub-scanning direction.

Pixel signals output from the CCD image sensor 35 reading the document are converted into image data by the analog-digital converter 43. The image data are sent to the line data reduction section 55.

In step 150, the image data are thinned out at the designated fixed reduction ratio for every line by the line data reduction section 55 while the image data are thinned out in the sub-scanning direction in accordance with the reduction ratio. In this manner, the line image data are stored in the line buffer 57. In this case, the data can be processed and reduced while reading a document because the reduction ratio has already been set. Accordingly, the processing speed can be improved compared with the case where the data are reduced by the ratio changing section 18 after the data are once stored in the memory. In the embodiment 1, the line data reduction section 55 performs the thinning-out process only in the fixed reduction ratio mode.

The line image data reduced thus are once stored in the line buffer 57 and then sent to the codec 15 (FIG. 1) successively. The line image data are encoded by the codec 15 and stored in the image memory 13.

In step 160, a judgment is made as to whether reading of all the area set in the step 130 is completed or not. In the case of "YES", the process proceeds to step 170. In the case of "NO", the process goes back to the step 150.

In step 170, centering is made so that an image will be formed on the center of the sheet of recording paper when the image is recorded on the sheet of recording paper based on the image data reduced in the step 150.

In step 180, a judgment is made as to whether the size of the image data reduced in the step 150 is larger than a size corresponding to the recording area of the recording section 9 or not. That is, a judgment is made as to whether the size of the image data in the main scanning direction is larger than a data size corresponding to the length of the recording area of recording paper in the main scanning direction or not, and whether the size of the image data in the sub-scanning direction is larger than a data size corresponding to the length of the recording area of recording paper in the sub-scanning direction or not. When the lengths of the image data in the main scanning direction and the sub-scanning direction are larger than the reference values respectively (in the case of "YES"), the process proceeds to step 190. Otherwise (in the case of "NO"), the process proceeds to step 90 (FIG. 3).

In step 190, portions of the image data overflowing the size corresponding to the recording area are trimmed so that the size of the image data can be contained in the recording area. The detailed description of trimming will be omitted because trimming is a known technique. Specifically, opposite ends of the image are trimmed while the center of the image is retained.

Figure 8:
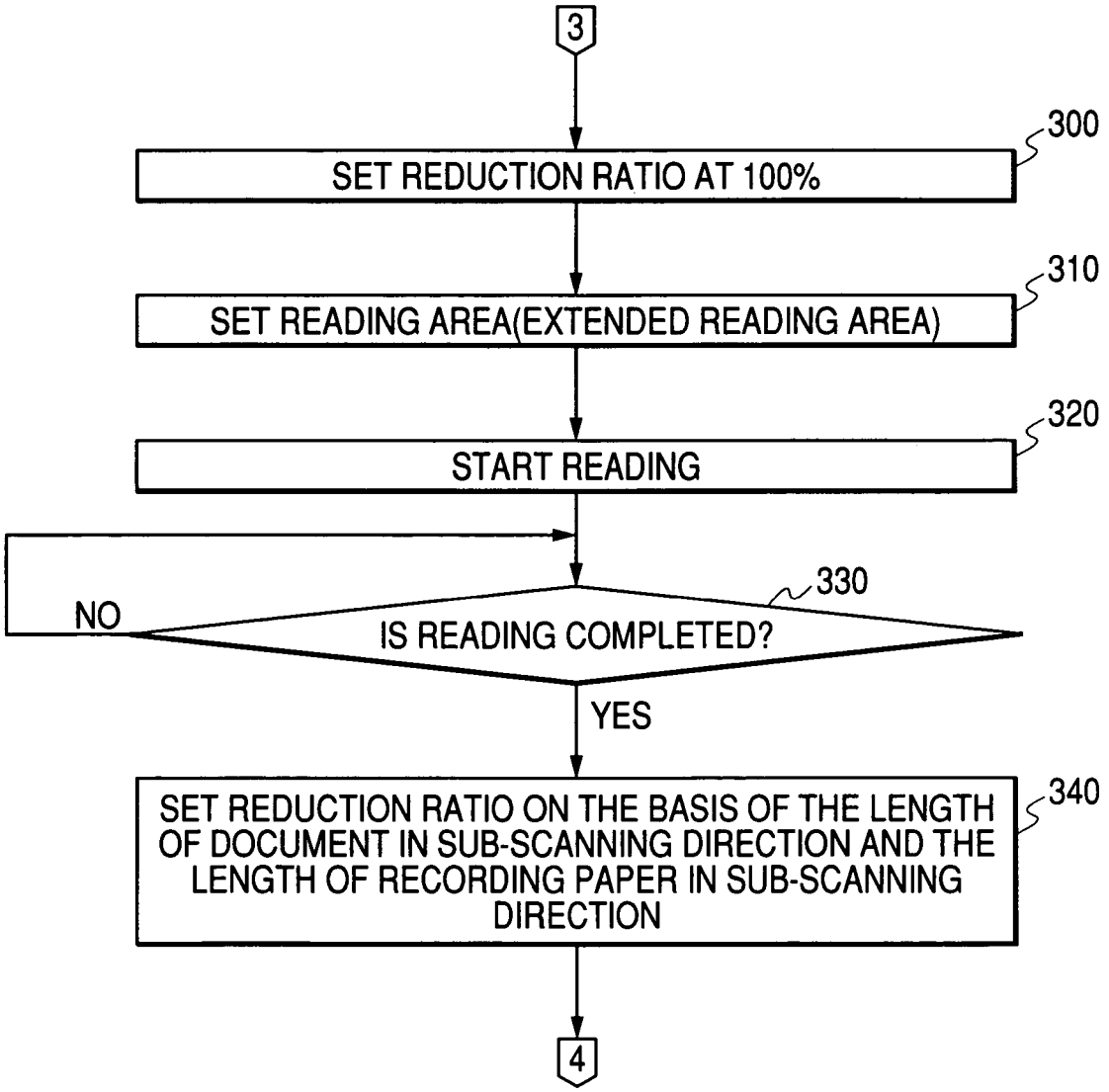
FIG. 8 is a flow chart showing a process executed by an FB-MFD according to another embodiment of the invention.
Figure 9A:
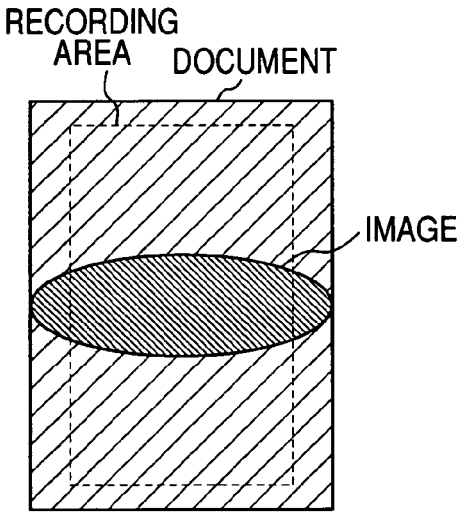
FIG. 9A PRIOR ART
FIGS. 9A and 9B are views for explaining a copying method carried out by a copying machine according to the background art.
Figure 9B:
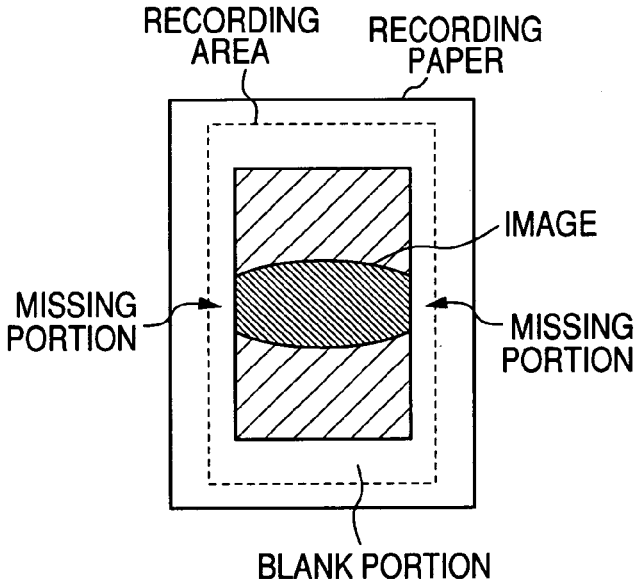
FIG. 9B PRIOR ART

On the other hand, when the judgment in the step 110 results in "NO" (that is, the auto reduction mode key 23 is selected in the operation section 11), the process proceeds to step 300 (FIG. 8). In the step 300, like the step 40, the reduction ratio of the ratio changing section 18 is once set at 100%.

In step 310, like the step 130, an area having a length of 297 mm in the sub-scanning direction and a width of 212 mm in the main scanning direction is set as the area to be read from the document by the CCD image sensor 35 of the reading section 7.

In step 320, like the step 140, reading of the document by the CCD image sensor 35 starts so that image data are stored in the image memory 13 successively.

In step 330, a judgment is made as to whether reading of the document is completed or not. In the case of "YES", the process proceeds to step 340. In the case of "NO", the step 330 is repeated.

In step 340, the reduction ratio S to be set in the ratio changing section 18 is decided according to the expression:

$$S=E/D$$

in which D is the length of the document in the sub-scanning direction, and E is the length of recording paper in the sub-scanning direction.

Incidentally, D and E are values that are decided in advance in accordance with the document size and the recording paper size input through the document size setting key 33 and the paper size setting key 31 in the operation section 11.

That is, in the step 340, the reduction ratio is set as the ratio of the length of recording paper in the sub-scanning direction to the length of the document in the sub-scanning direction.

After completion of the step 340, the process proceeds to step 170 (FIG. 4).

d) Effects obtained by the FB-MFD 1 according to the embodiment 1 and the copying method according to the embodiment 1 will be described below.

When the FB-MFD 1 according to the embodiment 1 is applied to reduction copying, even an image recorded out of an area corresponding to the recording area of the document can be recorded on a sheet of recording paper.

Figure 6A:
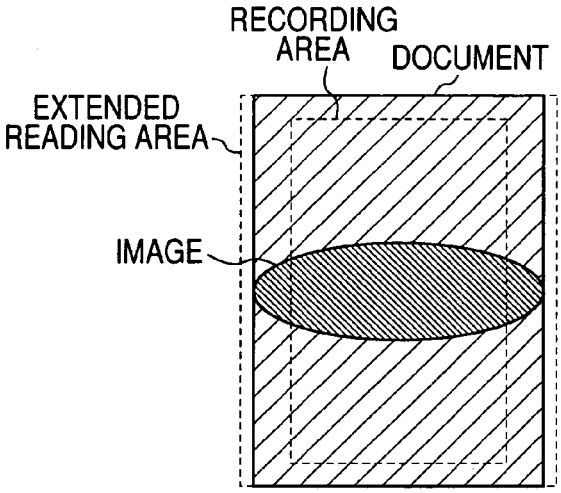
FIGS. 6A and 6B are views for explaining an operation and an effect obtained by the FB-MFD according to the embodiment.
Figure 6B:
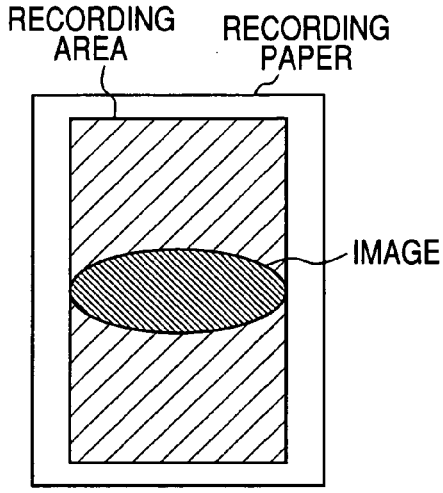

That is, in Embodiment 1, when the document is to be subjected to reduction copying (i.e. when the judgment in the step 30 results in "NO"), an extended reading area larger than the recording area of recording paper is read from the document as shown in FIG. 6A for forming image data. Accordingly, the image data contains an image formed in the inside of the area corresponding to the recording area, and an image formed in the outside of the recording area. When the image data are reduced and recorded on a sheet of recording paper, (at least a part of) the image formed in the outside of the recording area of the document can be recorded on the sheet of paper because the image is present within the recording area of the sheet of recording paper as shown in FIG. 6B.

Hence, when the FB-MFD 1 according to the embodiment 1 and the copying method according to the embodiment 1 is applied to reduction copying, a missing portion of the image (a portion of the image recorded on the document but not recorded on the sheet of recording paper) formed on the sheet of recording paper can be reduced.

In the FB-MFD 1 according to the embodiment 1, because the extended recording area larger than the recording area is read from the document, copy loss can be reduced even in the case where the document is placed on the document table to be skew.

Figure 7A:
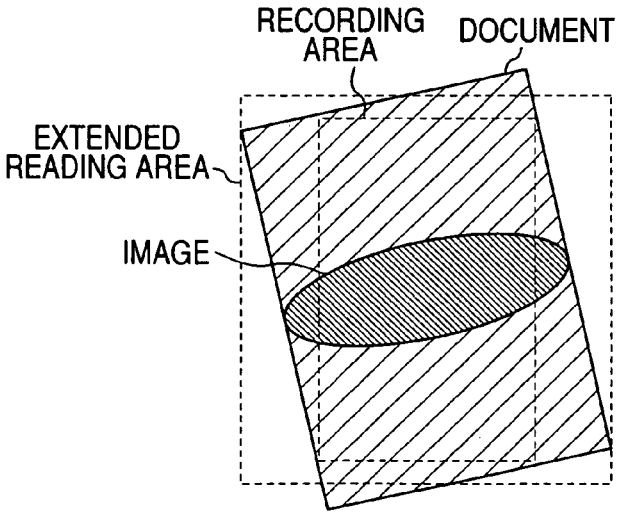
FIGS. 7A and 7B are views for explaining the operation and effect obtained by the FB-MFD according to the embodiment.

That is, when the document is placed to be skew, a portion that is supposed to be originally contained in the inside of the area of the document corresponding to the recording area of recording paper (when the document is placed correctly) may come out of the area. In the embodiment 1, the portion that may come out of the recording area when the document is placed to be skew as described above, however, can be read to be contained in the image data because the extended reading area larger than the recording area is read from the document as shown in FIG. 7A.

Figure 7B:
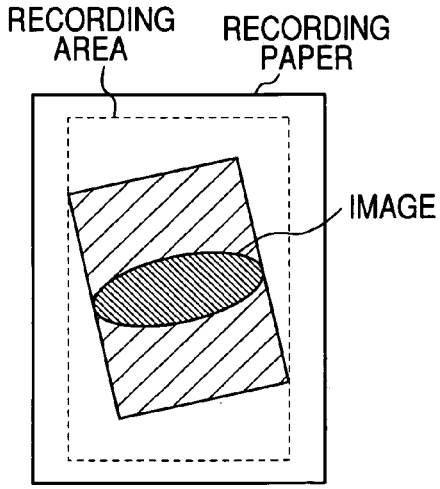

When the image data are then reduced and recorded on the sheet of recording paper, (at least a part of) the image formed in the portion out of the area of the document corresponding to the recording area due to skew can be recorded on the sheet of recording paper because the image is present within the recording area of the sheet of recording paper as shown in FIG. 7B.

In the embodiment 1, when the extended recording area is read from the document, the reading pitch in the main scanning direction becomes larger than that in the case where the recording area is read from the document. Therefore, an amount of image data corresponding to one line become larger than an amount of the image data corresponding to one line in the case where the recording area is read from the document.

In the embodiment 1, processing can be however made speedily without necessity of reducing the image data after reading of the document because the line data reduction section 55 thins out the image data corresponding to one line in advance.

In the embodiment 1, when the auto reduction mode key 23 is selected, the reduction ratio is set in the step 340 in FIG. 8.

When the reduction ratio is set in the step 340, copying can be made so that the length of image data in the sub-scanning direction coincides with the length of the recording area of recording paper in the sub-scanning direction. Accordingly, increase in a blank portion having no image recorded on the sheet of recording paper can be avoided and the image can be prevented from coming out of the recording area of the sheet of recording paper.

When, for example, the auto reduction ratio setting mode is selected, user's labor for setting the reduction ratio can be omitted.

Embodiment 2

An FB-MFD according to an embodiment 2 has the same configuration as that according to the embodiment 1. The process executed by the FB-MFD according to the embodiment 2 is basically the same as that executed by the FB-MFD 1 according to the embodiment 1.

In the embodiment 2, the extended reading area is however always used as the area to be read from the document by the reading section 7. Accordingly, setting of an area to be read (i.e., the steps 50, 130 and 310 in the embodiment 1) are not carried out.

The FB-MFD according to the embodiment 2 and the copying method according to the embodiment 2 have the same effects as in the embodiment 1.

In the embodiment 2, settings concerning the area to be read in the actual-size copy mode need not be distinguished from those in the reduction copy mode. There is an advantage that the copying process can be simplified.

Embodiment 3

An FB-MFD according to an embodiment 3 has the same configuration as that according to the embodiment 1. The process executed by the FB-MFD according to the embodiment 3 is basically the same as that executed by the FB-MFD 1 according to the embodiment 1.

Incidentally, in the embodiment 3, a document is placed on the document feed tray 104 and the ADF mechanism 102 reads the document. The embodiment 3 is different from the embodiment 1 in a processing for a case where the operator selects the auto reduction mode key 23 of the operation section 11 (that is, a process after the decision in the step 110 results in "NO").

When the judgment in the step 110 results in "NO", the process proceeds to step 200 (FIG. 5). In step 200, like the step 300, the reduction ratio of the ratio changing section 18 is once set at 100%.

In step 210, like the step 310, an area (extended recording area) having a length of 297 mm in the sub-scanning direction and a width of 212 mm in the main scanning direction is set as the area to be read from the document by the CCD image sensor 35 of the reading section 7.

In step 220, like the step 320, the CCD image sensor 35 starts reading the document. The image data are sent to the codec 15 successively. The image data are encoded by the codec 15 and recorded in the image memory 13.

In step 230, a judgment is made as to whether or not it is completed to read a document in the sub-scanning direction. Specifically, the ADF mechanism 102 includes a sensor (e.g. mechanical or optical sensor) for detecting passage of both ends of a document. The sensor is provided on a carrying path of a document so that a size of a document can be detected as a transferring distance between the front and rear ends of a document. For example, when passage of an end of a document is detected two times, it is deemed that the reading of a document is completed.

When the reading of a document is completed ("YES"), the process proceeds to step 240. When the reading of a document is not completed ("NO"), the process proceeds to step 250.

In step 240, the reduction ratio S to be set in the ratio changing section 18 is decided according the expression:

$$S=B/(A\times C)$$

in which A is number of lines of an image, which is picked up by the line sensor, B is the length of the recording area of recording paper in the sub-scanning direction, and C is the distance between adjacent lines.

Incidentally, A is a numerical value proportional to the size of the image data in the sub-scanning direction, and B is a value proportional to the length of recording paper in the sub-scanning direction. Accordingly, S is proportional to the ratio of the length of recording paper in the sub-scanning direction to the length of the image data in the sub-scanning direction.

After the step 240, the process proceeds to step 270 in which the image data are reduced by the ratio changing section 18. Then, the process proceeds to step 170.

On the other hand, when the judgment in the step 230 results in "NO", the process proceeds to step 250. In the step 250, a judgment is made as to whether the number of lines in the sub-scanning direction is larger than a predetermined upper limit or not. There may be a case where a document has a quite long length in sub-scanning direction. Therefore, it is necessary to perform the step 250. Let consider the converse case. If the step 250 is omitted (e.g., when the step 230 results in "NO", the process repeats the step 230), the ratio changing section 18 reduces image data of such a document having the long length (e.g. about 10 meters) to A4 size. However, it is impossible to read the reduced image recorded in a recording paper of A4 size because, for example, a character on the document is reduced to quite small size. Specifically, the predetermined upper limit corresponds to 90 cm. It should be understood that the predetermined upper limit may be set desirably. In the case of "YES", the process proceeds to step 260. In the case of "NO", the process goes back to step 230.

In step 260, a predetermined lower limit of the reduction ratio S (for example, 70%) is set in the ratio changing section 18. After the step 260, the process proceeds to step 270 (FIG. 5).

The FB-MFD according to the embodiment 3 and the copying method according to the embodiment 3 have the same effects as in Embodiment 1.

When the reduction ratio is set in the step 260, the reduction ratio can be prevented from being reduced excessively.

Embodiment 4

An FB-MFD according to an embodiment 4 has the same configuration as in the embodiment 1. The process executed by the FB-MFD according to the embodiment 4 is basically the same as that executed by the FB-MFD according to the embodiment 1.

The embodiment 4 is however different from the embodiment 1 in the setting of the reduction ratio in the auto reduction mode (i.e., the step 340 in the embodiment 1). That is, in the embodiment 4, the reduction ratio S to be set in the ratio changing section 18 is decided according to the expression:

$$S=G/F$$

in which F is the length of the document in the main scanning direction, and G is the length of recording paper in the main scanning direction.

Incidentally, F and G are values that are decided in advance in accordance with the document size and the recording paper size input through the document size setting key 33 and the paper size setting key 31 in the operation section 11.

That is, in Embodiment 4, the reduction ratio is set as the ratio of the length of recording paper in the main scanning direction to the length of the document in the main scanning direction.

The FB-MFD according to the embodiment 4 and the copying method according to the embodiment 4 have the same effects as in the embodiment 1.

Embodiment 5

An FB-MFD according to an embodiment 5 has the same configuration as in the embodiment 1. The process executed by the FB-MFD according to the embodiment 5 is basically the same as that executed by the FB-MFD according to the embodiment 1.

Figure 12:
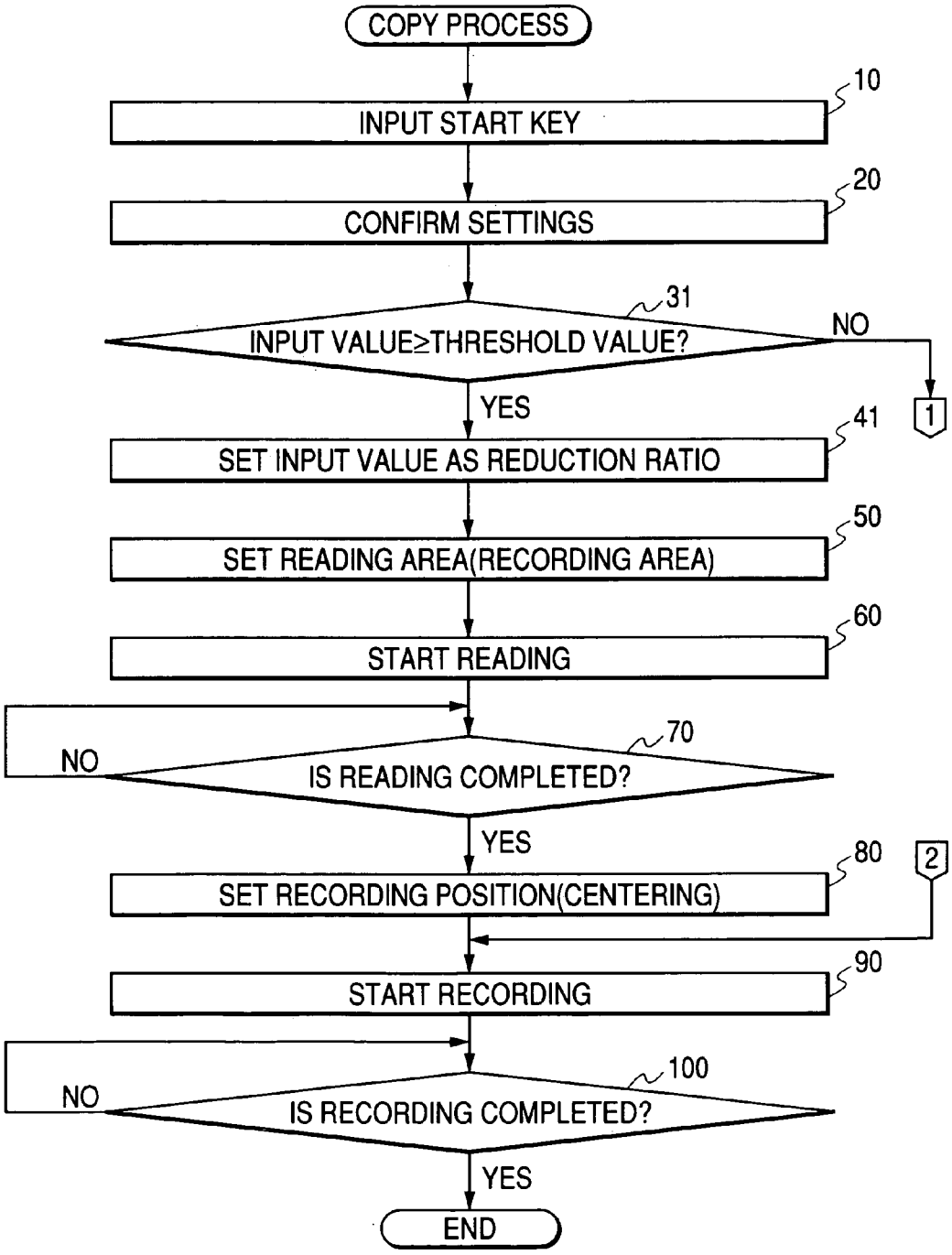
FIG. 12 is a flow chart showing a process executed by an FB-MFD according to still another embodiment of the invention.

The embodiment 5 adopts steps 31 and 41 instead of the steps 30 and 40 of the embodiment 1 (FIG. 12). In the step 31, a judgment is made as to whether or not a value (reduction ratio) input by an operator through the reduction ratio setting key 29 is greater than or equal to a threshold value (for example, 90%). The threshold value is set in advance and may be changeable. If the judgment in the step 31 results in "YES", the process proceeds to the step 41. For example, when the threshold value is set to 90% and the value input by the operator is 95%, the judgment in the step 31 results in "YES". On the other hand, if the judgment in the step 31 results in "NO", the process proceeds to the step 110. For example, when the threshold value is set to 90% and the value input by the operator is 80%, the judgment in the step 31 results in "NO".

If an operator selects the actual-size copy mode key 25, the value input by an operator is deemed as 100%. If an operator selects the auto reduction mode key 23, that is, an operator does not input the value through the reduction ratio setting key 29, the judgment in the step 31 results in "NO".

In step 41, the value (e.g., any value in a range of from 1% to 99%) input by the operator through the reduction ratio setting key 29 is set as the reduction ratio of the ratio changing section 18.

It is manner of course that the invention is not limited to the embodiments at all, and that various changes or modifications may be made without departing from the scope of the invention.

When, for example, the recording paper size is a letter size (216 mm wide), the reading pitch may be set at 210 mm.

In the step 240 in the embodiment 3, the reduction ratio may be calculated on the basis of the ratio of the length of recording paper in the main scanning direction to the size of image data in the main scanning direction.

In this case, the reduction ratio is decided on the basis of the length of the image in the sub-scanning direction even if the image is recorded on only a part of the document. Accordingly, increase in the black portion having no image recorded on the recording medium can be avoided.

In each of embodiments 1 to 4, the reading section 7 may be made of an analog reading unit for reading the document by forming an image on a photoconductor.

In each of embodiments 1 to 4, mechanical or optical sensors may be used as a unit for detecting the document size and the recording paper size, respectively. For example, the mechanical or optical sensors may be provided on carrying paths of the document or recording paper so that the passage of front and rear ends of the document or recording paper can be detected. In this manner, the document size or recording paper size can be detected on the basis of the carrying distance between the detected front end and the detected rear end of the document or recording paper.

In another embodiment, the reading section 7 always read an extended reading area of a document to generate image data. Then, the image memory 13 stores the image data in a similar manner to the embodiment 1. The image data stored is reduced at the reduction ratio stored in the ratio changing section 18. However, if the reduction ratio stored is greater than or equal to a predetermined threshold level, a portion of the image data, which is out of the recording area of the recording medium, is discarded after the reduction of the image data. Thereafter, the recording section 9 forms an image on the recording medium based on the remaining reduced image data. It should be understood that such discarding may be applied to the image data before reduced.

What is claimed is:

1. A copying machine comprising:

a reading unit which reads a document to generate image data;

a reducing unit which reduces the image data at a predetermined reduction ratio to generate reduced image data; and a recording unit which forms an image in a first recording area on a recording medium on the basis of one of the image data generated by the reading unit and the reduced image data generated by the reducing unit, wherein:

the first recording area corresponds to the recording medium, and at least when the recording unit forms the image on the basis of the reduced image data, the reading unit reads an extended reading area of the document larger than a second recording area corresponding to a size of the document.

2. The copying machine according to claim 1, wherein when the reducing unit is not used, the reading unit reads an area of the document equal to the recording area.

3. The copying machine according to claim 1, wherein when the recording unit forms the image on the basis of the image data generated by the reading unit, the reading unit reads an area of the document equal to the recording area.

4. The copying machine according to claim 1, wherein when the recording unit forms the image on the basis of the image data generated by the reading unit, the reading unit reads the extended reading area of the document.

5. The copying machine according to claim 1, wherein the extended reading area of the document is an area larger in a main scanning direction than the recording area of the recording medium.

6. The copying machine according to claim 1, wherein a ratio of a length of the recording medium in a sub-scanning direction to a length of the document in the sub-scanning direction is set as the reduction ratio.

7. The copying machine according to claim 6, wherein the reading unit detects the length of the document in the sub-scanning direction.

8. The copying machine according to claim 1, wherein a value in proportion to a ratio of a length of the recording medium in a sub-scanning direction to a length of the image data in the sub-scanning direction is set as the reduction ratio.

9. The copying machine according to claim 1, wherein a ratio of a length of the recording medium in a main scanning direction to a length of the document in the main scanning direction is set as the reduction ratio.

10. The copying machine according to claim 1, wherein when the reading unit detects a length of the document in a sub-scanning direction greater than or equal to a predetermined threshold value, the reduction ratio is set to a predetermined value.

11. The copying machine according to claim 1, further comprising:

a buffer which temporarily stores the image data generated by the reading unit before outputting the image data to the reducing unit or the recording unit; and a preparatory reducing unit which thins out the image data before storing the image data in the buffer.

12. A copying method comprising:

reading a document to generate image data;

reducing the image data at a predetermined reduction ratio to generate reduced image data; and forming an image in a predetermined recording area on a recording medium on the basis of one of the image data generated in the reading and the reduced image data generated in the reducing, wherein:

at least when in the forming, the image is formed on the basis of the reduced image data, an extended reading area of the document, which is larger than the recording area, is read in the reading.

13. The copying method according to claim 12, wherein when the reducing is not performed, an area of the document equal to the recording area is read in the reading.

14. The copying method according to claim 12, wherein the image is formed on the basis of the image data in the recording, an area of the document equal to the recording area is read in the reading.

15. The copying method according to claim 12, wherein when the image is formed on the basis of the image data in the recording, the extended reading area of the document is read in the reading.

16. The copying method according to claim 12, wherein the extended reading area of the document is an area larger in a main scanning direction than the recording area of the recording medium.

17. The copying method according to claim 12, further comprising:

setting a ratio of a length of the recording medium in a sub-scanning direction to a length of the document in the sub-scanning direction as the reduction ratio.

18. The copying method according to claim 17, further comprising:

detecting the length of the document in the sub-scanning direction.

19. The copying method according to claim 12, further comprising:

setting a value in proportion to a ratio of a length of the recording medium in a sub-scanning direction to a length of the image data in the sub-scanning direction as the reduction ratio.

20. The copying method according to claim 12, further comprising:

a ratio of a length of the recording medium in a main scanning direction to a length of the document in the main scanning direction as the reduction ratio.

21. The copying method according to claim 12, further comprising:

detecting a length of the document in a sub-scanning direction; and setting the reduction ratio to a predetermined value when the length of the document in the sub-scanning direction is greater than or equal to a predetermined threshold value.

22. A copying machine comprising:

a reduction ratio setting section which sets a reduction ratio;

a control section which compares the reduction ratio with a threshold value;

an effective area setting section which detects a length of a document in a main scanning direction to set an effective area being larger than a recording area having a size of the document;

a reading section which reads the document to generate image data;

a data processing section which reduces the image data on the basis of a comparison result provided by the control section, the image data, and the effective area; and a recording section which forms an image on a recording area of a recording medium on the basis of the image data reduced by the data processing section.

23. The copying machine according to claim 22, wherein when the control section determines that the reduction ratio is smaller than the threshold value, the effective area setting section sets the effective area to be larger than the recording area.

24. The copying machine according to claim 22, wherein when the control section determines that the reduction ratio is greater than or equal to the threshold value, the effective area setting section sets the effective area to correspond to the recording area.

25. The copying machine according to claim 22, wherein when the control section determines that the reduction ratio is greater than or equal to the threshold value, the data processing section discards a portion of the reduced image data, which is out of the recording area, and the recording section forms the image on the basis of the remaining reduced image data.

26. The copying machine according to claim 22, wherein the effective area setting section sets the effective area so that a length of the effective area in the main scanning direction is larger than the detected length of the document in the main scanning direction.

27. The copying machine according to claim 22, wherein the effective area setting section sets the effective area so that a length of the effective area in the main scanning direction is larger than a length of the recording area of the recording medium in the main scanning direction.

28. The copying machine according to claim 22, wherein the reduction ratio setting section sets a ratio of a length of the recording medium in a sub-scanning direction to a length of the document in the sub-scanning direction as the reduction ratio.

29. The copying machine according to claim 22, wherein the reduction ratio setting section sets a value in proportion to a ratio of a length of the recording medium in a sub-scanning direction to a length of the image data in the sub-scanning direction as the reduction ratio.

30. The copying machine according to claim 22, wherein the reduction ratio setting section sets a ratio of a length of the recording medium in a main scanning direction to a length of the document in the main scanning direction as the reduction ratio.

31. The copying machine according to claim 1, wherein the extended reading area of the document is larger than a size of the document.

32. The copying method according to claim 12, wherein the extended reading area of the document is larger than a size of the document.

33. The copying machine according to claim 23, wherein when the control section determines that the reduction ratio is smaller than the threshold value, the effective area setting section sets the effective area to be larger than a size of the document.

34. The copying machine according to claim 1, wherein the extended reading area of the document is larger than a maximum size of the first recording area.

35. The copying method to claim 12, wherein the extended reading area of the document is larger than a maximum size of the first recording area.

36. The copying machine according to claim 23, wherein when the control section determines that the reduction ratio is smaller than the threshold value, the effective area setting section sets the effective area to be larger than a maximum size of the recording area.

* * * * *